US006848216B2

(12) United States Patent
Engelgau et al.

(10) Patent No.: US 6,848,216 B2
(45) Date of Patent: Feb. 1, 2005

(54) SINGLE DRIVE SYSTEM FOR DRIVING COMPONENTS OF SLIDING VEHICLE CLOSURE MEMBER

(75) Inventors: Steven John Engelgau, Royal Oak, MI (US); Shelley Lynn Bess, Royal Oak, MI (US); Rajesh J. Somnay, Troy, MI (US); Silvio M. Yamada, Waterford, MI (US); Christopher Matthew Radjewski, Sterling Heights, MI (US); Ian Christopher Hoare, West Bloomfield, MI (US); Joseph Allen Wilbanks, II, Hermitage, TN (US)

(73) Assignee: ArvinMeritor Technology LLC, Troy, MI (US)

( * ) Notice: Subject to any disclaimer, the term of this patent is extended or adjusted under 35 U.S.C. 154(b) by 41 days.

(21) Appl. No.: 10/375,666

(22) Filed: Feb. 27, 2003

(65) Prior Publication Data

US 2004/0168371 A1 Sep. 2, 2004

(51) Int. Cl.[7] ..... E05F 11/54
(52) U.S. Cl. ..... 49/360; 49/352
(58) Field of Search ..... 49/360, 280, 352, 49/348, 349, 350, 351

(56) References Cited

U.S. PATENT DOCUMENTS 3,145,988 A * 8/1964 Colautti et al. ..... 49/280
3,713,472 A * 1/1973 Dozois ..... 160/189
4,337,596 A * 7/1982 Kern et al. ..... 49/210
4,478,004 A * 10/1984 Andrei-Alexandru et al. . 49/72
5,551,190 A 9/1996 Yamagishi et al.
5,764,010 A * 6/1998 Maue et al. ..... 318/443
5,852,943 A * 12/1998 Dutka et al. ..... 70/237
5,907,885 A * 6/1999 Tilli et al. ..... 15/250.16
5,920,159 A * 7/1999 Miller et al. ..... 318/4
6,036,257 A 3/2000 Manuel
6,038,818 A 3/2000 Haag et al.
6,079,767 A 6/2000 Faubert et al.
6,100,619 A 8/2000 Buscher et al.
6,125,583 A * 10/2000 Murray et al. ..... 49/291
6,135,513 A 10/2000 Hamada et al.
6,290,283 B1 9/2001 Fukumoto et al.
6,397,523 B1 6/2002 Fukumoto et al.
6,412,222 B1 7/2002 Hashiba et al.
6,418,668 B1 7/2002 Arquevaux
6,430,875 B1 8/2002 Clark et al.
6,477,806 B1 * 11/2002 Asada et al. ..... 49/169
6,513,285 B2 * 2/2003 Isomura ..... 49/351
2004/0139657 A1 * 7/2004 Fukumoto et al. ..... 49/350

* cited by examiner

*Primary Examiner*—Gregory J. Strimbu
(74) *Attorney, Agent, or Firm*—Carlson, Gaskey & Olds

(57) ABSTRACT

A common drive system drives multiple systems within a sliding vehicle closure member with a single drive motor. A controller selectively connects the drive motor to either a door drive assembly, a window drive assembly, or a lock module drive assembly through a selector assembly in response to actuation of a particular input. The selector assembly includes a transmission which shifts the drive motor between multiple gear trains to drive the particular drive assembly.

7 Claims, 1 Drawing Sheet

SINGLE DRIVE SYSTEM FOR DRIVING COMPONENTS OF SLIDING VEHICLE CLOSURE MEMBER

BACKGROUND OF THE INVENTION

The present invention relates to a drive system for vehicle closure members, and more particularly to a drive system which eliminates duplication of drive motor components located within a sliding vehicle door.

In various types of vehicles, it is known to provide a sliding door where the door moves along a fixed path generally parallel to a side wall of the vehicle. Sliding vehicle doors typically include a multiple of powered systems such as hinge assemblies, powered sliding door systems, control switches, door latch modules, and window-raising mechanism.

The powered door drive system drives the sliding door along a guide track between an open and a closed position. The latch module remotely locks and unlocks the sliding door and the window-raising mechanism opens and closes a window pane or window vent. Each powered system requires a drive system typically including an electric motor and drive linkage specific to the system. All of these components are commonly contained within a rather small area between an outer and inner panel of the sliding vehicle door. The multiple of components and operation thereof may create installation and arrangement difficulties within the door. Moreover, some vehicles incorporate sliding doors on each side of the vehicle which still further multiple the number of drives systems and expense.

Accordingly, it is desirable to reduce the number of components located within the vehicle door to provide cost, weight and space savings.

SUMMARY OF THE INVENTION

The common drive system according to the present invention drives a multiple of drive systems within a vehicle closure member with a single drive motor. A selector assembly selectively connects the selector assembly to either a door drive assembly, a window drive assembly, or a lock module drive assembly in response to actuation of a particular input. The selector assembly includes a transmission which shifts the drive motor between the first gear train, the second gear train or the third gear train.

In operation, a controller activates the selector assembly to engage the desired gear train. The controller then operates the drive motor in the desired direction to drive the gear train which drives the desired feature. By selectively connecting the drive motor to the desired device, duplication of the drive motor is eliminated. The controller also operates the selector assembly to minimize the blocking out of functions.

The present invention therefore reduces the number of components located within a vehicle door to provide cost, weight and space savings.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
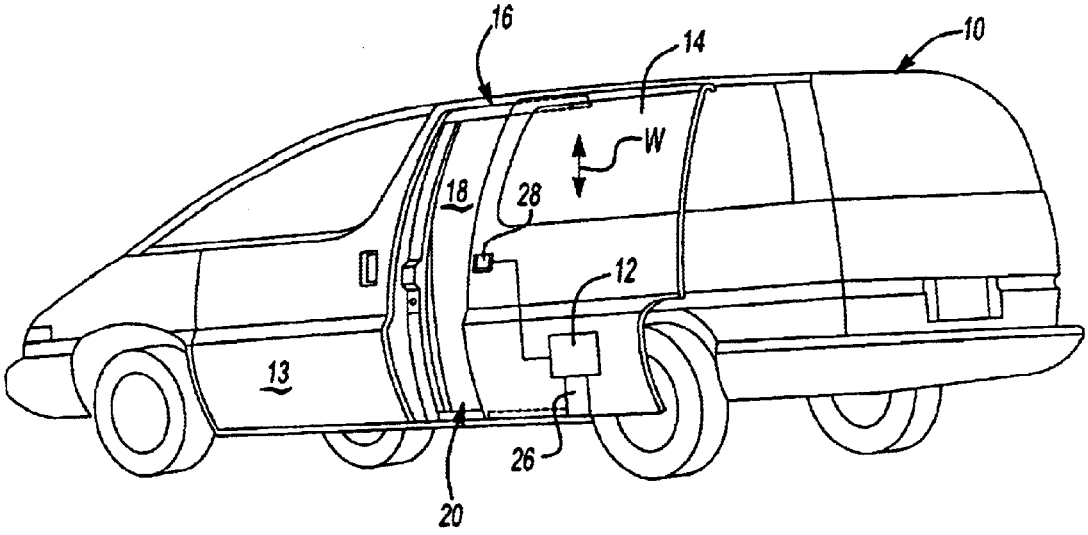
FIG. 1 is a generally schematic side view of a sliding vehicle closure member with a drive system according to the present invention.

FIG. 1 illustrates a general perspective view of a vehicle 10. Vehicle 10 includes a hinged front passenger door 13 and a sliding side door 14. The sliding side door 14 preferably includes a common drive system (illustrated schematically at 12) for powered systems within the vehicle door 14. The sliding door 14 is supported and guided by an upper track 16 adjacent opening 18 and a lower track 20 adjacent opening 18. It should be understood that relative terms such as "upper" and "lower" are used with regard to the Figures for purposes of understanding and are not to be considered limiting.

Operation of a sliding door for a van type vehicle is well known and understood and need not be described in detail. Suffice it to say, a drive system 26 drives the sliding door 14 between an open position and a closed position via an input 28.

Figure 2:
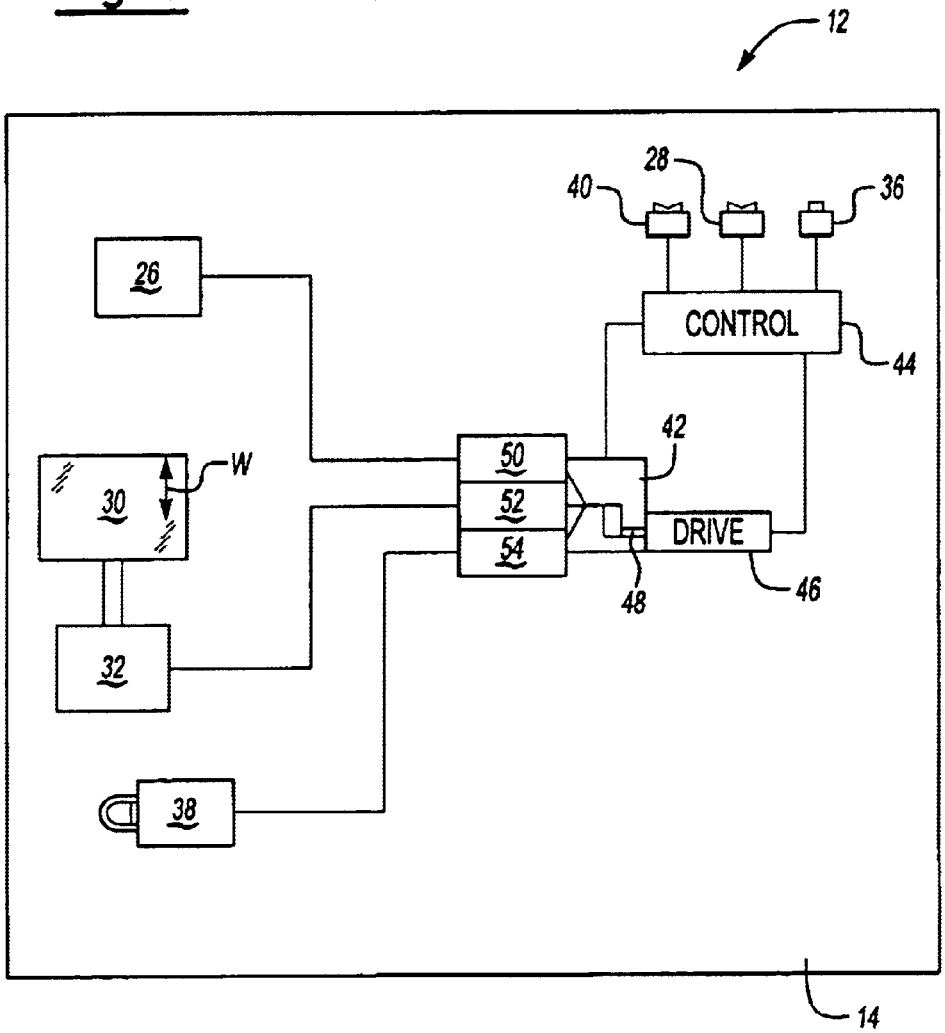
FIG. 2 is a schematic view of the drive system of FIG. 1.

FIG. 2 illustrates the common drive system 12 for powered systems within the vehicle closure 12. Drive system 26 may include various power mechanisms such as gears, belts, tracks and the like to drive the door 14 (FIG. 1) between open and closed positions. The first input 28 is preferably a switch, button or the like which is manipulated by a user to open and close the door. Switch 28 may additionally or alternatively be a remote control key fob or the like.

The vehicle door 14 includes a window 30 driveable by a window drive assembly 32. As known, the window 30 is selectively movable in the direction of double-headed arrow W in response to a second input 36. The second input 36 is preferably a switch, button or the like which is manipulated by a user to operate the window 30.

The vehicle door 14 also includes a lock module drive assembly (illustrated schematically at 38). The lock module drive assembly 38 is provided at the front of the sliding door 14 to latch the door 14 in the closed position. The lock module drive assembly 38 is typically connected to a third input 40 such as a switch, button or the like to selectively connect the lock module drive assembly 38.

Preferably, a selector assembly 42 selectively operates the door drive assembly 26, the window drive assembly 32, and the lock module drive assembly 38. A controller 44 communicates with the first input 28, the second input 36, the third input 40 and the selector assembly 42. The controller 44 selectively connects the selector assembly 42 to either the door drive assembly 26, the window drive assembly 32 or the lock module drive assembly in response to actuation of either the first input 28, the second input 36, or the third input 40.

A drive motor 46 having an output 48 drives the system 12. A first gear train 50 drives the door drive assembly 26 to move the vehicle door 14 between an open and a closed position. A second gear train 52 drives the window drive assembly 32 to drive the window 30 along arrow W. A third gear train 54 drives the lock module door drive assembly 26 between a locked and an unlocked condition. It should be understood that although a gear train is provided in the disclosed embodiment, other systems for operating a lock module drive assembly and a window drive assembly such as linkages, cables, and electrical systems will benefit from the present invention.

The selector assembly 42 preferably selectively interconnects the output 48 of the drive motor 46 to either the first gear train 50, the second gear train 52 or the third gear train 54 to selectively power the respective door drive assembly 26, the window drive assembly 32, or the lock module drive assembly 38. The selector assembly 42 is preferably a transmission which shifts power from the output 48 between the first gear train 50, the second gear train 52 or the third gear train 54. It should be understood that other selectors such as clutch and cam arrangements will benefit from the present invention.

In operation, a user desires to open the window 30 (FIG. 1) and actuates the second input 36. In response, the controller 44 activates the selector assembly 42 to engage the second gear train 52. The controller 44 then operates the drive motor 46 in the desired direction to drive the second gear train 52 which drives the window drive assembly 32. The second input 36 may then be released by the user when the window 30 (FIG. 1) reaches the desired position.

Importantly, by selectively connecting the drive motor 46 to the desired device, duplication of the drive motor is eliminated. However, the drive motor 46 is connectable to only one of the devices during any time period. It is therefore preferred that the controller 44 operates the selector assembly 42 in a manner that minimizes the blocking out of the functions. For example only, should the lock be actuated during window closure both inputs are being operated simultaneously. The controller 44 preferably momentarily stops operation of the window drive assembly 32 which requires a period of time to operate. The controller 44 then actuates the lock module drive assembly 38 which only requires a relatively short period of time to operate compared to operate the window drive assembly. In other words, the locking of a lock requires a shorter period of motor operation than that of opening or closing the window or door. In this way, a user closing/opening the window/door and actuating the lock, may only notice a momentary pause in window/door operation during which the lock module drive assembly will be locked and then the window will continue closing.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A drive system comprising:

a drive motor having an output;

a lock module drive assembly;

a window drive assembly;

a door drive assembly which drives a sliding door between a first position and a second position; and a selector assembly selectively movable between a first position in which said output engages said lock module drive assembly such that said drive motor operates said lock module drive assembly, a second position in which said output engages said window drive assembly such that said drive motor operates said window drive assembly, and a third position in which said output engages said door drive assembly such that said drive motor operates said door drive assembly.

2. The system as recited in claim 1, wherein said lock module drive assembly comprises a first gear train, said window drive assembly comprises a second gear train, and said door drive assembly comprises a third gear train.

3. The system as recited in claim 1, wherein said selector assembly comprises a transmission.

4. The system as recited in claim 1, wherein said selector assembly shifts between a first gear train which drives said lock module drive assembly, a second gear train which drives said window drive assembly and a third gear train which drives said door drive assembly.

5. The system as recited in claim 1, further comprising a control in communication with said selector assembly to selectively move said selector assembly.

6. The system as recited in claim 1, further comprising a control in communication with said selector assembly to selectively move said selector assembly from a first gear train to a second gear train to momentarily stop operation of said first gear train to drive said second gear train and then move said selector back to said first gear train to drive said first gear train.

7. The system as recited in claim 1, wherein said selector assembly communicates with only one of a plurality of gear trains in each said selector assembly position.

* * * * *